US010591195B2

(12) United States Patent
Renna

(10) Patent No.: US 10,591,195 B2
(45) Date of Patent: Mar. 17, 2020

(54) CONTROL METHOD FOR DEFROSTING THE OUTDOOR COIL OF A HEAT PUMP MACHINE

(71) Applicant: INGERSOLL-RAND INTERNATIONAL LTD, Swords, Co. Dublin (IE)

(72) Inventor: Giuseppe Giovanni Renna, Bari (IT)

(73) Assignee: INGERSOLL-RAND INTERNATIONAL LTD, Dublin (IE)

( * ) Notice: Subject to any disclaimer, the term of this patent is extended or adjusted under 35 U.S.C. 154(b) by 0 days.

(21) Appl. No.: 15/757,082

(22) PCT Filed: Sep. 4, 2015

(86) PCT No.: PCT/IT2015/000210

§ 371 (c)(1),
(2) Date: Mar. 2, 2018

(87) PCT Pub. No.: WO2017/037747

PCT Pub. Date: Mar. 9, 2017

(65) Prior Publication Data

US 2018/0245830 A1 Aug. 30, 2018

(51) Int. Cl.
*F25B 47/02* (2006.01)
*F25B 49/02* (2006.01)

(52) U.S. Cl.
CPC ..... *F25B 47/025* (2013.01); *F25B 49/02* (2013.01); *F25B 49/022* (2013.01); *F25B 2500/19* (2013.01); *F25B 2700/2106* (2013.01); *F25B 2700/21174* (2013.01); *F25B 2700/21175* (2013.01)

(58) Field of Classification Search
CPC ..... F25B 47/02; F25B 47/022; F25B 47/025; F25B 49/02; F25B 49/022; F25B 2500/19; F25B 2700/2016; F25B 2700/21174; F25B 2700/21175
See application file for complete search history.

(56) References Cited

U.S. PATENT DOCUMENTS 5,257,506 A * 11/1993 DeWolf ..... F25D 21/006 62/155

FOREIGN PATENT DOCUMENTS

| | | |
|---|---|---|
| EP | 0299361 | 1/1989 |
| EP | 1055885 | 11/2000 |
| EP | 2489964 | 8/2012 |

OTHER PUBLICATIONS

International Search Report for international appl. No. PCT/IT2015/000210, dated May 3, 2016 (2 pages).

* cited by examiner

*Primary Examiner* — Marc E Norman
(74) *Attorney, Agent, or Firm* — Hamre, Schumann, Mueller & Larson, P.C.

(57) ABSTRACT

Method for controlling defrosting of the outer exchanger of a heat pump machine, comprising the steps of: defining in the outer air temperature/evaporation temperature plane three zones; acquiring the outer air temperature and the evaporation temperature; individuating in which zone of the Taria_ext/T_evap plane the point falls, identified by the two acquired temperature measures; inverting the machine functioning cycle when the point falls in an unsafe zone; reducing the rotation speed of the compressor of said heat pump machine when the point falls in an intermediate zone.

15 Claims, 2 Drawing Sheets

| T Aria EXT | DT FOR SAFE ZONE | DT FOR INTERMEDIATE ZONE | DT FOR UNSAFE ZONE |
|---|---|---|---|
| °C | °C | °C | °C |
| -13 | < 5 | 5 < DT < 9 | > 9 |
| 0 | < 7 | 7 < DT < 9 | > 9 |
| 7 | < 7 | 7 < DT < 9 | > 9 |
| 15 | < 13 | 13 < DT < 16 | > 16 |
| > 15 | < 13 | 13 < DT < 16 | > 16 |

CONTROL METHOD FOR DEFROSTING THE OUTDOOR COIL OF A HEAT PUMP MACHINE

TECHNICAL FIELD OF THE INVENTION

The present invention relates to a control method for defrosting the outer exchanger of heat pump machines.

STATE OF THE ART

At state of the art it is known that the evaporation batteries of the machines for heat pump production of heating and sanitary hot water, in which the thermal source is ambient air, are subjected to the phenomenon of formation of frost. In fact in this kind of machines, when it is needed only heat as useful effect (for sanitary hot water or for heating ambients) it is needed to draw low temperature heat from the outer thermal source.

Therefore, it is clear that by cooling the air flow passing through the thermal exchange battery, conditions can occur in which the humidity contained in the air condensates first and ices on the battery in the following.

This phenomenon is harmful and has to be avoided for many reasons, first of all the reduction in useful thermal exchange surface of the outer battery which limits the heat which is possible to be drawn. Once an ice layer is formed on the outer battery it is needed to carry out long inversion cycles (working cycles in which the heat pump heats the outer battery by subtracting heat from the inner storage tank, this effect being clearly undesired).

In the control logics of defrosting known at the state of the art, the cycle inversion is activated when the evaporation pressure (or evaporation temperature, since the two variables are clearly linked) reaches a pre-set threshold of defrosting start.

The control logics based only on this variable have drawbacks, since the evaporation temperature does not always indicate correctly the presence of ice on the battery. In fact, the evaporation temperature tends to decrease while the outer air temperature decreases, regardless of the relative humidity of the same (this parameter affecting the ice formation significantly).

Therefore aim of the present invention is to provide a control logic of defrosting to be used in heat pump machines, which allows to reduce the conditions in which it is needed to invert the working cycle. According to another aim, the present invention provides a control logic of defrosting to be applied in heat pump machines able to intervene before a frost layer is formed on the outer batteries, by intervening when the monitoring of some physical variables, better described in the following, indicates a condition of presence or beginning of frost formation. According to another aim the present invention provides a method for defining the conditions in which the presence or beginning of frost formation is provided.

As it is described in the following, the present invention provides a method for controlling defrosting of the outer exchanger of a heat pump machine configured to exchange heat between an outer cold source (ambient air) and a hot source, said machine being provided with means able to carry out, on command, the cycle inverted to the just described one, said method comprising the steps of:

a) defining in the outer air temperature (Taria_ext)/evaporation temperature (T_evap) plane a first (310) and a second (320) separation line which define three zones (A, B, C) within said plane;

b) acquiring (220) the outer air temperature (Taria_ext);

c) acquiring (210) the evaporation temperature (T_evap);

d) individuating (220) in which zone of the Taria_ext/T_evap plane the point falls, identified by the two acquired temperature measures;

e) inverting the machine functioning cycle when said point falls in an unsafe zone (C), arranged under said second separation line (320);

f) reducing the rotation speed of the compressor of said heat pump machine when said point falls in an intermediate zone (B), comprised between said first (310) and second (320) separation line;

g) acquiring Taria_ext and T_evap values again after a predetermined time interval;

h) annulling the actions in step e) or f) when said point falls in a safe zone (A); otherwise repeating the step g).

These and other advantages will be clear from a detailed description of the invention, with reference to the appended FIGS. 1 to 4.

BREIF DESCRIPTION OF THE DRAWINGS

DETAILED DESCRIPTION

Conveniently it is to be précised firstly that "outer air temperature" (Taria_ext) means the temperature of ambient air at the thermal exchange battery; evaporation temperature (T_evap) means the temperature of liquid/vapour phase passage of the coolant in the thermal exchange battery. It is known that, once the kind of coolant is defined, this temperature is linked to the evaporation pressure.

Moreover it is to be précised that what described in the following can be applied to any heat pump machine which can be configured to exchange heat between an outer cold source (ambient air) and a hot source (normally, but not limitingly, a storage tank), and which is provided with cycle inversion valves or equal means for carrying out, on command, the cycle inverted to the just described one.

It is also to be précised that the operations of measuring the physical quantities (pressures and temperatures), of data processing and storage and of valve actuation for the cycle inversion described in the following can be carried out according to any mode known at the state of the art, without departing from the aim of the present invention.

Figure 1:
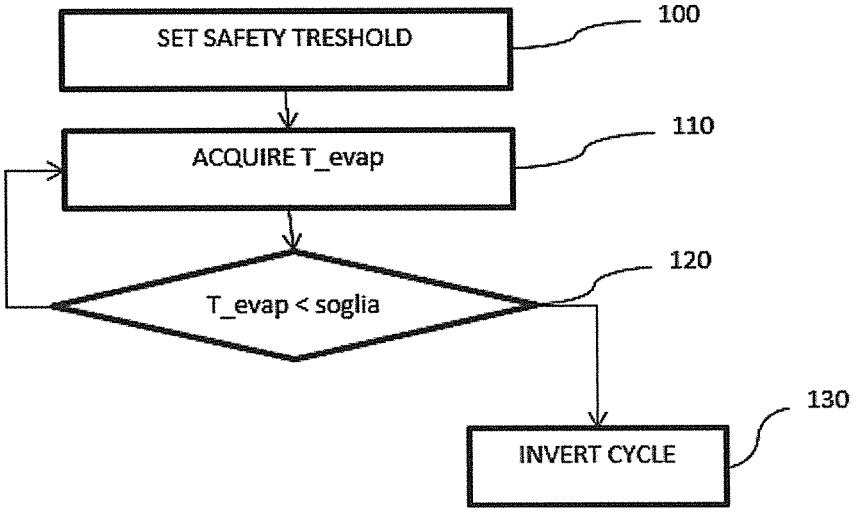
FIG. 1 shows a flowchart representing the control logics of defrosting known at the state of the art, in which it is shown how the decision of activating the inverted cycle or not is taken according to the comparison of the evaporation temperature and pre-set threshold temperature.
Figure 2:
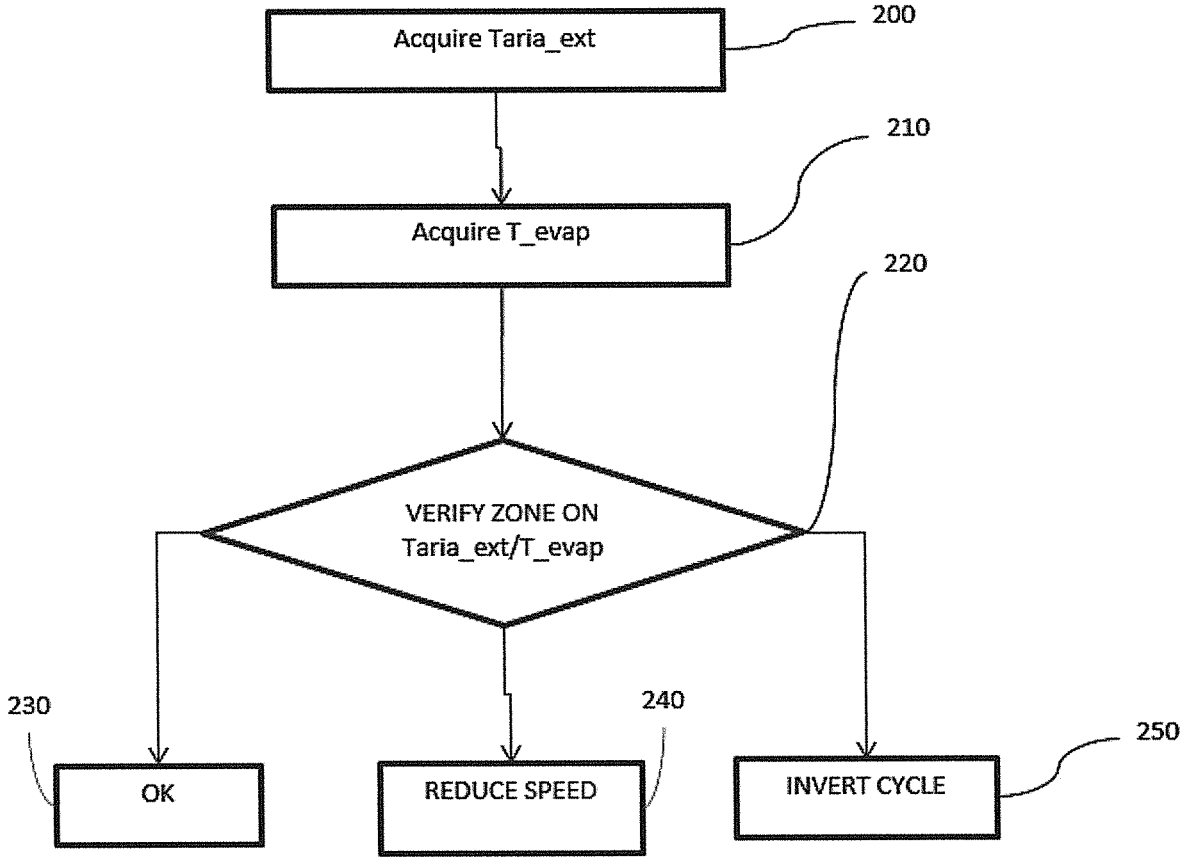
FIG. 2 shows a flowchart explaining a preferred embodiment of the control logic according to the present invention.

As it is shown in FIG. 2, the control logic according to the present invention provides to acquire (200) a measure of outer air temperature (Taria_ext) and to acquire (210) a measure of evaporation temperature (T_evap) as well, and in the following to verify (220) in which zone of the Taria_ext/T_evap plane the point falls, identified by the two acquired temperature measures.

Figures 3, 4:
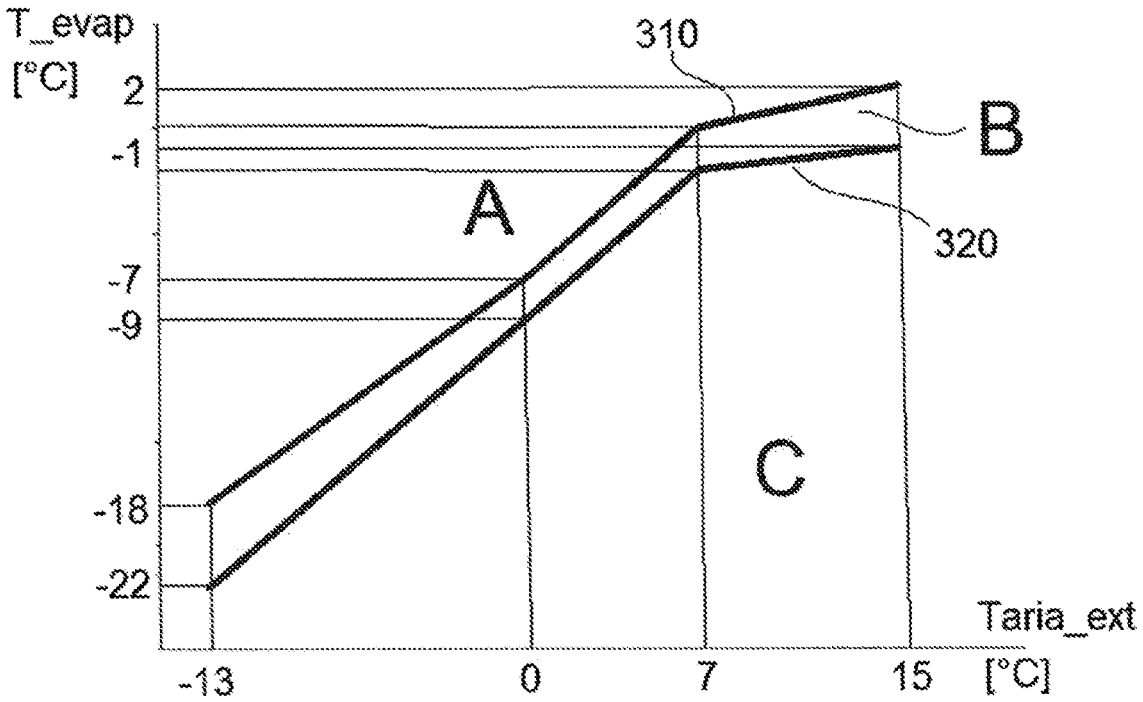
FIG. 3 shows a graph of outdoor air temperature (Taria_ext) against evaporation temperature.
FIG. 4 shows a table of evaporation temperature values (DT) according to the outer air temperature (Tana_ext).

According to the values of the two measures of temperature in fact the point can fall in a safe zone (A), in an intermediate zone (B) or in an unsafe zone (C), shown in FIG. 3 and defined by a first (310) and a second (320)

separation line. The two separation lines (310, 320) are defined, as described in detail in the following, according to the temperature of outer air and to the temperature difference between inner air and outer air. It is to be précised that in the following the term DT means the difference between the outer air temperature and the evaporation temperature.

In the safe zone (A) arranged on the first delimiting line (310) no intervention of defrosting is carried out; in the unsafe zone (C) arranged under the second delimitation line (320) the cycle inversion is activated; in the intermediate zone (B) comprised between the two delimiting lines (310, 320), if the machine is provided with compressor, whose number of revolutions is adjustable, normally because it is provided with an inverter, the rotation speed of the compressor is reduced, and as a consequence, the thermal load subtracted from the ambient air. The action of reduction speed rotation is carried out for a settable time interval, at the end of which if DT is not reduced, by bringing the functioning point within the safe zone (A) again, the cycle is inverted. This adjustment action by reducing revolutions allows to defrost the thermal exchange battery without carrying out any defrosting cycle in 80% of cases, with remarkable advantages on energy efficiency.

Both the reduction in number of revolutions (240) and the cycle inversion (250) are applied until the functioning point moves again in the zone (A) shown in FIG. 3. The two described actions (240, 250) are preferably applied until the functioning point remains constantly in the safe zone (A) of FIG. 3 for a minimum time interval.

A first definition of the three zones (A, B, C) can be provided by the manufacturer, for each model of machine at the planning stage. A better definition of these three zones can be then implemented according to the real installation conditions, according to what described in detail in the following.

The basic logic of the definition of the three zones (A, B, C) is the following: when it is known the thermal power subtracted by the machine from ambient air flow in regime conditions, the difference between the outer air temperature and the evaporation temperature (DT) contains an implicit indication of frost formation; if frost formed on the exchange battery, the useful surface of air passage on the battery would be reduced, with consequent increase in DT needed to dispose of the same thermal power, and so, a consequent reduction in evaporation temperature.

For this reason, when DT (DT=Taria_ext−T_evap) is lower than a determined value according to the outer air temperature, it can be concluded to be within a functioning safe zone (A), as it is shown in the appended graph; while DT increases, one passes from an intermediate zone (B), where the frost formation can be considered at the beginning, and in the following, to a zone of sure formation of frost (C).

FIG. 4 shown a table of DT values according to the outer air temperature, which can be used do define the two delimiting lines (310, 320). It is absolutely clear that the shown values are to be intended as example and not limiting the aims of the present invention.

As yet said, another advantage of the method according to the present invention is to be able to implement, in the time, a better definition of the zones (A, B, C) which define the actions to be undertaken to avoid formation of frost on the machine.

In fact the method can comprise additional passages, described in the following.

Once the machine is installed, a suitable datalogger stores the duration of defrosting cycles carried out and the outer air temperature of the same. When the average duration of the defrosting cycles is lower than a settable threshold value, the DT value defining the two delimiting lines (310, 320) is increased, so that the range of functioning conditions, which are considered "safe", is widened. Preferably the modification of the definition of the just described safe functioning conditions occurs after dividing the interval of possible temperatures of the outer air into a plurality of sub-intervals, for each one of which the average value of defrosting cycles is recorded.

The sub-intervals are preferably more than or equal to three; in addition, the threshold value to modify the setting of defrosting cycles duration is preferably 2 minutes; the increase is preferably 10% of the DT value.

The invention claimed is:

1. A control method for defrosting an outdoor coil of a heat pump machine configured to exchange heat in a first cycle between an external cold source comprising ambient outdoor air, and a hot source, and, on command, in a second reverse cycle between the hot source and the external cold source, the heat pump machine comprising a compressor, the method comprising:

a) defining, in a plane of Outdoor Air Temperature (Taria_ext) against evaporation temperature (T_evap), a first and a second line of separation, said first and second lines of separation defining three zones (A,B,C) within said plane;

b) measuring an outdoor air temperature (Taria_ext);

c) measuring an evaporation temperature (T_evap);

d) identifying in which of the three zones (A,B,C) of the plane of Taria_ext against T_evap a point identified by the Taria_ext and T_evap measurements falls;

e) operating the heat pump machine in the second reverse cycle when the point falls in zone (C) and is below said second line of separation;

f) decreasing a rotation speed of the compressor of the heat pump machine when the point falls in zone (B) and is between said first and second lines of separation;

g) measuring Taria_ext and T_evap after a predetermined time interval;

h) repeating steps d) to g) until the point identified by the Taria_ext and T_evap measurements falls in zone (A) and is above said first line of separation.

2. The control method for defrosting the outdoor coil of a heat pump machine according to claim 1, wherein said first and second lines of separation are defined in the plane of Taria_ext against T_evap as a function of the value DT=Taria_ext−T_evap.

3. The control method for defrosting the outdoor coil of a heat pump machine according to claim 2, wherein said first and second lines of separation defining the three zones (A,B,C) in which the value of DT is defined according to values in the following table:

| T Aria EXT | A | B | C |
|---|---|---|---|
| −13 | <5 | 5 < DT < 9 | >9 |
| 0 | <7 | 7 < DT < 9 | >9 |
| 7 | <7 | 7 < DT < 9 | >9 |
| 15 | <13 | 13 < DT < 16 | >16 |
| >15 | <13 | 13 < DT < 16 | >16. |

4. The control method for defrosting the outdoor coil of a heat pump machine according to claim further comprising the steps of:

i) storing in a datalogger a duration of one or more occurrences of the second reverse cycle and the outdoor air temperature (Taria_ext) in which they have occurred;

j) computing an average duration of second reverse cycles carried out; and k) increasing the value of DT when the average duration of second reverse cycles is less than a threshold value.

5. The control method for defrosting the outdoor coil of a heat pump machine according to claim 4, wherein said threshold value is 2 minutes.

6. The control method for defrosting the outdoor coil of a heat pump machine according to according to claim 5, wherein the increase in the value of DT is 10% of the DT value.

7. The control method for defrosting the outdoor coil of a heat pump machine according to according to claim 6, wherein step k) occurs after a step of dividing an outside air temperature (Taria_ext) range into a plurality of sub-intervals, and wherein an average duration of second reverse cycles for each sub-interval is recorded in the datalogger.

8. The control method for defrosting the outdoor coil of a heat pump machine according to according to claim 7, wherein the number of sub-intervals is three or more.

9. The control method for defrosting the outdoor coil of a heat pump machine according to according to claim 5, wherein step k) occurs after a step of dividing an outside air temperature (Taria_ext) range into a plurality of sub-intervals, and wherein an average duration of second reverse cycles for each sub-interval is recorded in the datalogger.

10. The control method for defrosting the outdoor coil of a heat pump machine according to according to claim 9, wherein the number of sub-intervals is three or more.

11. The control method for defrosting the outdoor coil of a heat pump machine according to according to claim 4, wherein the increase in the value of DT is 10% of the DT value.

12. The control method for defrosting the outdoor coil of a heat pump machine according to according to claim 11, wherein step k) occurs after a step of dividing an outside air temperature (Taria_ext) range into a plurality of sub-intervals, and wherein an average duration of second reverse cycles for each sub-interval is recorded in the datalogger.

13. The control method for defrosting the outdoor coil of a heat pump machine according to according to claim 12, wherein the number of sub-intervals is three or more.

14. The control method for defrosting the outdoor coil of a heat pump machine according to according to claim 4, wherein step k) occurs after a step of dividing an outside air temperature (Taria_ext) range into a plurality of sub-intervals, and wherein an average duration of second reverse cycles for each sub-interval is recorded in the datalogger.

15. The control method for defrosting the outdoor coil of a heat pump machine according to according to claim 14, wherein the number of sub-intervals is three or more.

* * * * *